US007434503B2

(12) United States Patent
Comarmond

(10) Patent No.: US 7,434,503 B2
(45) Date of Patent: Oct. 14, 2008

(54) PRESSURE REGULATING DEVICE FOR A PERCUSSIVE HYDRAULIC APPARATUS

(75) Inventor: Jean-Sylvain Comarmond, Vourles (FR)

(73) Assignee: Montabert, Saint Priest (FR)

( * ) Notice: Subject to any disclaimer, the term of this patent is extended or adjusted under 35 U.S.C. 154(b) by 315 days.

(21) Appl. No.: 10/579,233

(22) PCT Filed: Dec. 2, 2004

(86) PCT No.: PCT/FR2004/003098

§ 371 (c)(1),
(2), (4) Date: Jun. 30, 2006

(87) PCT Pub. No.: WO2005/065892

PCT Pub. Date: Jul. 21, 2005

(65) Prior Publication Data

US 2007/0079697 A1 Apr. 12, 2007

(30) Foreign Application Priority Data

Dec. 11, 2003 (FR) ..... 03 14529

(51) Int. Cl.
*B25D 9/26* (2006.01)
*B25D 9/20* (2006.01)
*B25D 9/14* (2006.01)

(52) U.S. Cl. ..... 91/276; 91/235; 91/321; 91/328

(58) Field of Classification Search ..... 91/235, 91/321, 276, 328
See application file for complete search history.

(56) References Cited

U.S. PATENT DOCUMENTS

| | | | | |
|---|---|---|---|---|
| 3,592,109 | A * | 7/1971 | Eskridge | 91/276 |
| 3,991,655 | A | 11/1976 | Bouyoucos et al. | |
| 4,084,486 | A * | 4/1978 | Juvonen | 91/276 |
| 6,863,260 | B2 * | 3/2005 | Medina | 251/324 |

FOREIGN PATENT DOCUMENTS

| | | |
|---|---|---|
| GB | 630743 | 12/1946 |
| GB | 630743 | 10/1949 |
| WO | WO 00/78510 A2 | 12/2000 |

* cited by examiner

*Primary Examiner*—Igor Kershteyn
(74) *Attorney, Agent, or Firm*—Oliff & Berridge, PLC

(57) ABSTRACT

A percussive apparatus comprises a body inside of which a striking piston is mounted in a cylinder bore. Two axially offset pieces are mounted inside the cylinder bore of the body while being concentric to the piston, and a deformable washer is placed between said pieces. One of the pieces is stationary with regard to the other piece that, however, is mounted in a manner that enables it to slide inside the cylinder bore and to be displaced in the direction of the stationary piece while being subjected to the action of the supply pressure of the hydraulic fluid that acts upon the surface of the moving piece facing away from the side opposite the stationary piece. The displacement of the moving piece causes the elastic washer to deform in order to create a passage with a variable cross-section on the return circuit of the hydraulic fluid to the reservoir or on a circuit that diverts, to the return circuit, a portion of the delivery flow of the apparatus whereby regulating the input pressure.

9 Claims, 4 Drawing Sheets

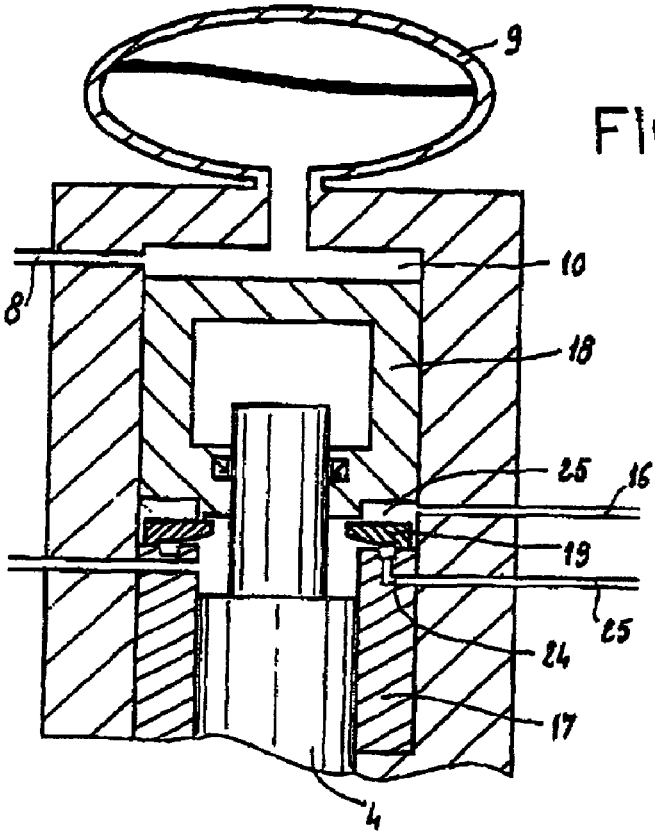
FIG 2
FIG 3
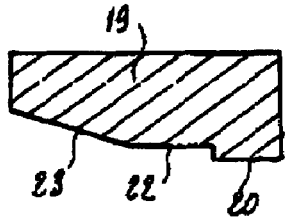
FIG 4
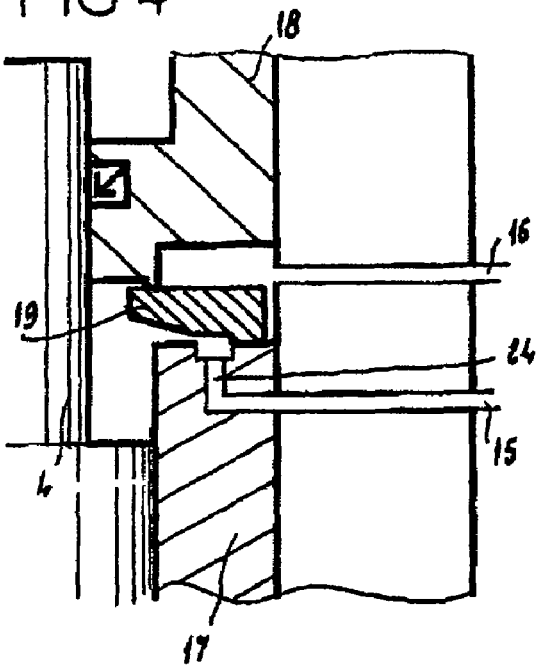
FIG 5
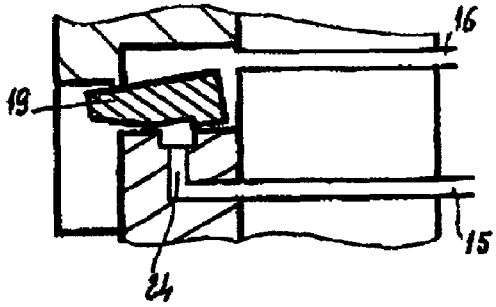
FIG 6
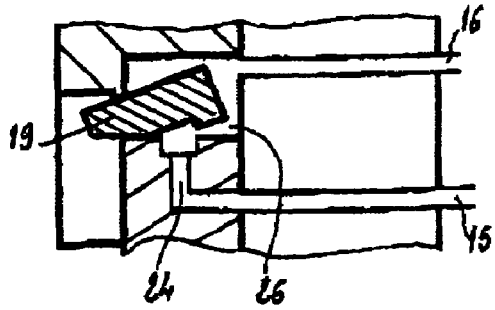

FIG 10
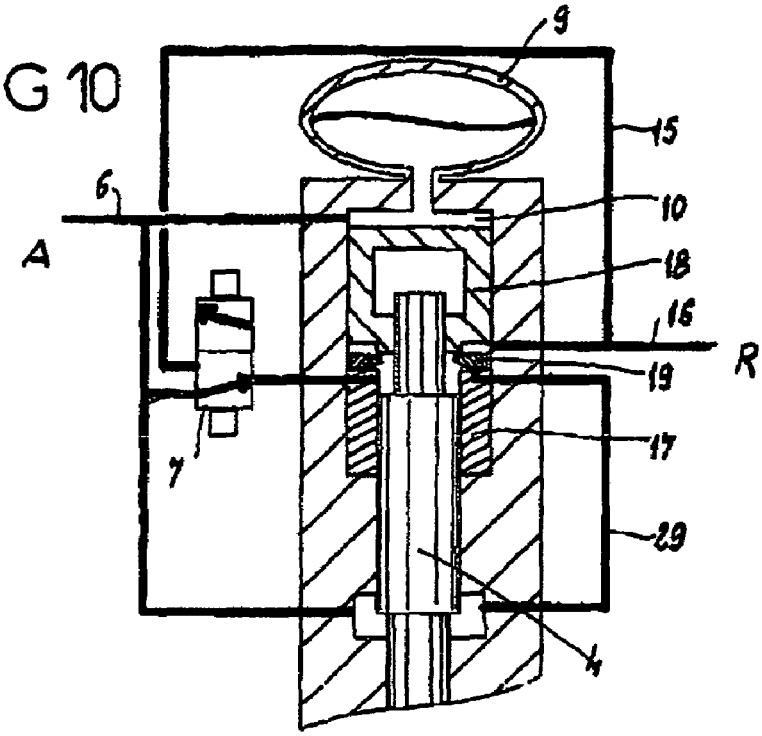
FIG 11
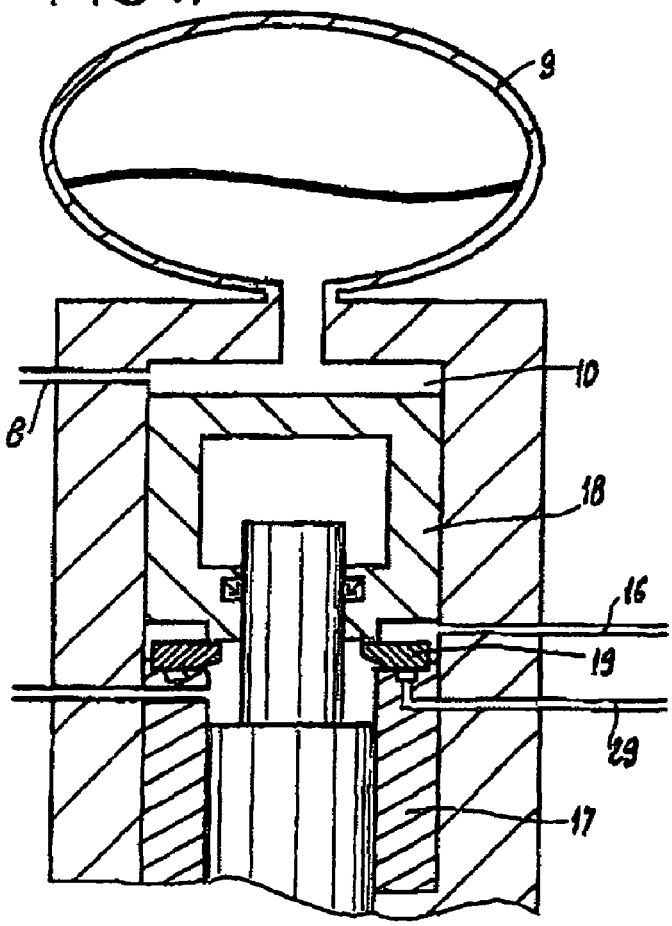
FIG 12
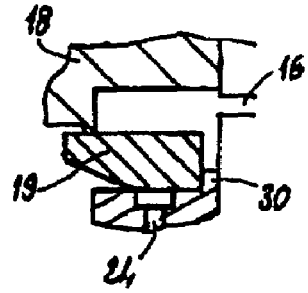
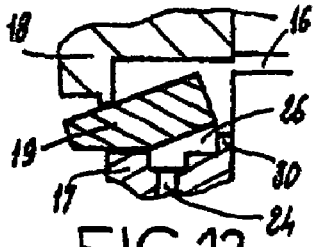
FIG 13

PRESSURE REGULATING DEVICE FOR A PERCUSSIVE HYDRAULIC APPARATUS

The subject of the present invention is a pressure regulation device for a hydraulic percussion appliance.

Hydraulic percussion appliances of the rock-breaking type are generally equipped with a percussion piston actuated by means of a hydraulic force resultant which pushes it alternately in one direction and then in the other, so as to strike a tool in contact with the material to be demolished.

High-power rock breakers are generally provided with a device making it possible to regulate the inlet pressure of the hydraulic fluid to a predetermined value which is adjustable so as to obtain the desired performances.

To be precise, if the flow of hydraulic fluid passing through the appliance is supplied by the hydraulic circuit of the carrying appliance, such as a hydraulic shovel, and depends on the said hydraulic circuit alone, the hydraulic fluid feed pressure, also called the inlet pressure, is determined at the design stage of the appliance, in order to give the piston the intended impact energy.

For economic reasons, low-power rock breakers are not generally equipped with a pressure regulation device.

These appliances are often provided with a nozzle or contraction on the hydraulic return circuit of the rock breaker, so that the pressure reaches the desired value, or else are provided with a pressure limiter which diverts part of the flow of hydraulic fluid towards the return circuit if the feed pressure exceeds the intended value.

The latter devices are not satisfactory, since the rock breaker risks functioning with an oil flow rate or oil viscosity different from those provided and risks causing internal damage to the striking mechanism.

The object of the invention is to provide a pressure regulation device which makes it possible to obtain an inlet pressure for the hydraulic fluid which is preset to a particular value. This device must be a simple and economical device which can be applied, in particular, to low-power rock breakers and the structure of which is composed of a set of cylindrical components fitted into the bore of the body of the rock breaker.

The device to which it relates is of the type comprising a body within which is formed a bore having a plurality of zones of different diameters and in which is mounted a piston having a plurality of zones of different diameters, the bore and the piston delimiting a plurality of chambers connected to the hydraulic circuit, in order, under the action of a distributor, to ensure an alternating movement of the piston which strikes against a tool.

According to the essential characteristic of the invention, two axially offset components are mounted in the bore of the body and concentrically to the piston, between which components a deformable washer is arranged, one of the components being immobile and the other component being mounted slidably in the bore and displaceably in the direction of the immobile component under the action of the hydraulic fluid feed pressure which is exerted on that face of the movable component which faces away from the immobile component, this displacement of the movable component causing a deformation of the elastic washer in order to give rise to a passage of variable cross section on the circuit for the return of the hydraulic fluid towards the reservoir or on a circuit which diverts part of the feed flow of the appliance towards the return circuit, so as to regulate the inlet pressure.

When the appliance is at rest, the elastic washer prevents any passage via the fluid return circuit and blocks the functioning of the rock breaker. When the feed pressure of the hydraulic fluid is sufficient, the movable component is displaced, thus causing a deformation of the elastic washer, so as to give rise to a passage towards the return circuit, the effect of which is to regulate the feed pressure to a limit value.

According to one embodiment of this device, the immobile component has formed in it a duct connected to the hydraulic fluid high-pressure feed duct, directly or via an internal chamber, or, by means of a distributor, to a chamber partially delimited by the piston and put alternately under high and low pressure, this duct issuing into that face of the immobile component which faces the movable component and on which the elastic washer rests, whilst a duct connected to the return circuit towards the reservoir issues into an annular volume located on that side of the elastic washer which is opposite to that bearing against the immobile component.

When the elastic washer is at rest, the two ducts issuing into the central bore do not communicate. During the deformation of the elastic washer, the latter gives rise to a passage of variable cross section which ensures that these two ducts are put into communication.

According to another characteristic of the invention, the movable component comprises, towards the immobile component, an annular recess delimiting a central nose intended for coming to bear on that part of the elastic washer which does not bear against the immobile component.

According to one possibility, the elastic washer possesses a cross section of rectangular general shape, the lower face of which has, from the outside inwards, a heel for bearing on the immobile component, and a surface which is parallel to the heel and set back from the latter and which is connected by means of an edge to a surface inclined from the outside inwards and from the immobile component towards the movable component.

The deformation of the elastic washer takes place by tilting about the edge.

According to another possibility, the elastic washer possesses a cross section of rectangular general shape, and that part of the wall of the immobile component which is located radially inwards and serves as a bearing means for the elastic washer is inclined from the outside inwards and in the opposite direction to the movable component.

According to another characteristic of the invention, the immobile component comprises an outer annular rim, the inside diameter of which is slightly smaller than the outside diameter of the elastic washer.

The elastically deformable washer may be produced from steel, in particular from spring steel.

Although, for reasons of simplicity, it is advantageous if the immobile component is separate from the body, it is likewise possible for it to form an integral part of the body.

In any event, the invention will be understood clearly from the following description, with reference to the accompanying diagrammatic drawing illustrating several pressure regulation devices by way of non-limiting example.

FIG. 2 is a partial view in longitudinal section, and on an enlarged scale, of that part of the appliance which comprises this first device.

FIG. 3 is a cross-sectional view, on an enlarged scale, of an elastic washer belonging to the regulation device illustrated in FIGS. 1 and 2.

FIGS. 4 to 6 are three partial views in longitudinal section, illustrating the regulation device during three functioning phases.

FIG. 10 is a view in longitudinal section, similar to FIG. 2, of a regulation device associated with a circuit which diverts part of the feed flow of the appliance.

FIG. 11 is a view in longitudinal section, and on an enlarged scale, of that part of the appliance which comprises the device.

FIGS. 12 and 13 are two partial views showing the position of the elastic washer ensuring regulation, respectively when the appliance is not fed and in the feed period of the appliance.

Figure 1:
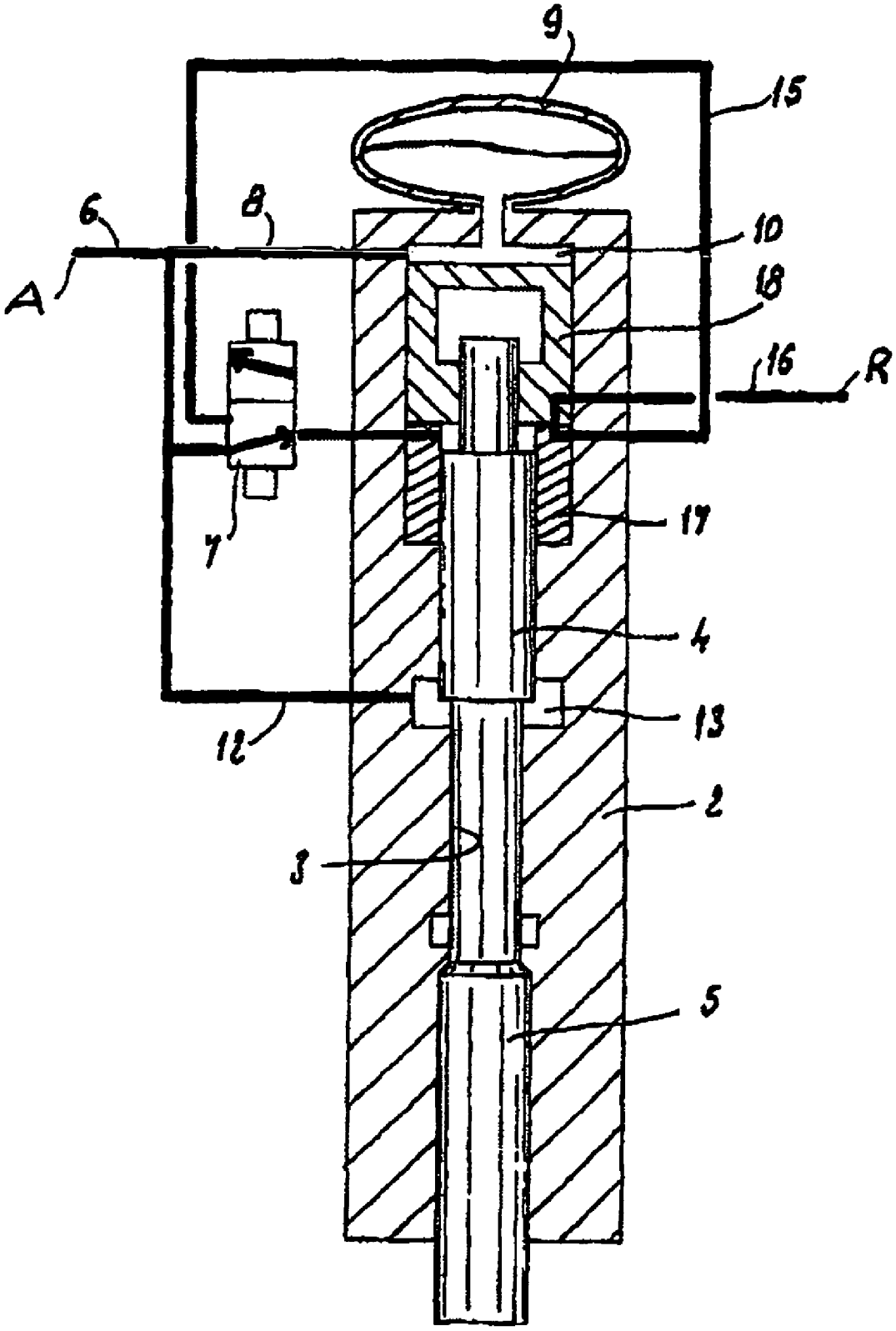
FIG. 1 is a view in longitudinal section of a hydraulic percussion appliance equipped with a first device.

FIG. 1 illustrates highly diagrammatically a hydraulic percussion appliance comprising a body 2, in which is formed a central bore 3 in which is mounted a striking piston 4 driven in an alternating movement and striking the head of a tool 5. In the drawing, the feed of hydraulic fluid under high pressure is identified by the reference A, and the return to the reservoir is identified by the reference R. The feed under high pressure delivers the fluid via a duct 6 which is connected to a hydraulic distributor 7 for controlling the movement. The duct 6 likewise feeds, via a duct 8, a hydraulic accumulator 9 and a chamber 10 communicating with the accumulator 9 and located at that end of the body 2 which is opposite that through which the tool passes. The duct 6 likewise feeds, via a duct 12, a chamber 13 for the ascent of the striking piston. A chamber 14 is connected to the distributor 7.

In a way known per se, the piston 4 has various shoulders over its length, in the region of the various chambers mentioned above. In practice, when the upper chamber 14 is fed with high-pressure fluid via the distributor 7, the piston is propelled downwards through its striking stroke. In the other position of the distributor 7, the upper chamber 14 is connected by means of ducts 15, 16 towards the low-pressure network R of the installation.

As shown in the drawing, particularly in FIGS. 1 and 2, the bore 3, in which the piston 4 is housed, contains an immobile annular component 17 partially delimiting the chamber 14. Above the immobile component 17 is arranged a movable component 18, the other end of which partially delimits the chamber 10. The low-pressure circuit consisting of the ducts 15, 16 passes through the two components 17, 18 which are mounted concentrically to the piston.

An elastic washer 19 is mounted between the two immobile 17 and movable 18 components. In the embodiment illustrated in FIGS. 1 to 6, the washer 19 is delimited by three perpendicular faces and a fourth lower face comprising, from the outside inwards, a heel 20 and a surface parallel to the heel 20 and connected by means of an edge 22 to a surface 23 which, in the embodiment illustrated in the drawing, is inclined from the bottom upwards and from the outside inwards.

The elastic washer 19 may be produced from various materials, in particular from steel. As shown in FIGS. 2 to 6, the duct 15 coming from the distributor 17 is prolonged by a duct portion 24 within the immobile component 17 and, in the upwardly facing wall of this component, issues into that zone of the latter which is contained between the heel 20 and the edge 22. The return of the reservoir via the duct 16 takes place above the elastic washer 19 in the region of a recess 25 which the movable component 18 comprises. When the appliance is not fed with hydraulic fluid under pressure, the components occupy the position illustrated in detail in FIGS. 2 and 4. In this case, the elastic washer 19 is plane, it bears with its heel 20 on the immobile component 17, and the movable component 18 bears on its upper face, in such a way that there is no communication between the duct 15 and the duct 16 for return towards the reservoir.

When the appliance commences functioning, the hydraulic pressure will increase in the accumulator 9 and the chamber 10, thus tending to displace the movable component 18 in the direction of the immobile component 17. When the pressure increases, but has not reached a predetermined value, the washer 19 is deformed, as shown in FIG. 5, but without ensuring that the ducts 15 and 16 are put into communication with one another. When the hydraulic fluid pressure increases, the elastic washer 19 is deformed increasingly under the growing force of the high pressure exerted on the movable component 18 which bears locally on the upper face of the washer, the position of this bearing contact being offset inwards with respect to the position of the heel 20 and of the edge 22. This offset bearing contact generates an elastic deformation of the shape of the washer 19. With the edge 22 coming to bear against the immobile component 17, as shown in FIG. 6, a hydraulic passage 26 is formed between the ducts 15 and 16. The evacuation in the appliance is then triggered, and the rock breaker can begin to function normally. The starting pressure is determined by this first level of deformation of the washer. When the pressure increases further, the lifting height of the heel 20 with respect to the immobile component 17 forms a variable contraction 26, the dimension of which depends on the deformation of the elastic washer 19 and therefore on the value of the high hydraulic pressure of the appliance. During the entire normal running phase of the percussion appliance, the loss of head on the evacuation circuit 15, 16 brought about by the variable contraction 26 depends on the high pressure and consequently makes it possible to regulate this pressure to a calculated value.

The geometry of the washer is intended to be deformed by a known value, so as to obtain, via the passage 26, a hydraulic passage cross section corresponding to the loss of head on the evaluation circuit which is necessary in order to obtain the desired high-pressure value.

Figure 7:
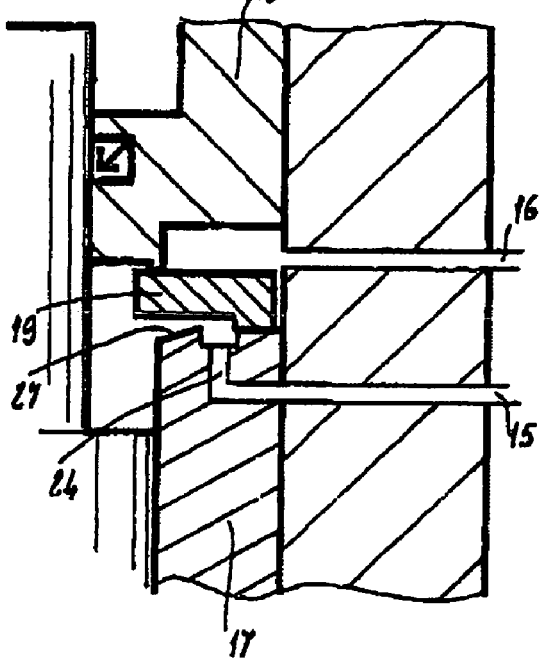
FIGS. 7 and 8 are two partial sectional views, similar to FIGS. 4 to 6, illustrating a regulation device equipped with another washer, in two functioning positions.
Figure 8:
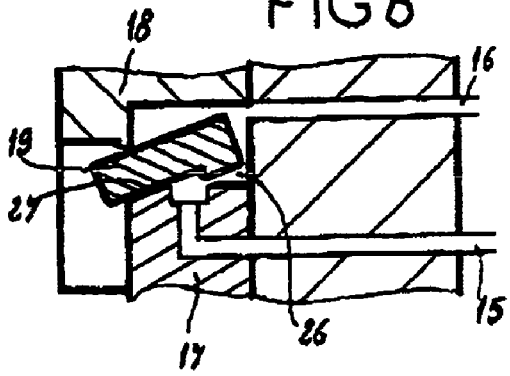

FIGS. 7 and 8 illustrate an alternative embodiment, in which the elastic washer 19 does not comprise an inclined surface 23, this inclined surface being replaced by a slope 27 formed on the end face of the immobile component 17, this slope being inclined from the top downwards and from the outside inwards. FIG. 7 shows the washer when the appliance is not being fed, whilst FIG. 8 shows the appliance during functioning, with a hydraulic passage 26 of variable cross section being formed. In the present case, the deformation of the washer occurs along with the bearing of the latter on the slope 27.

Figure 9:
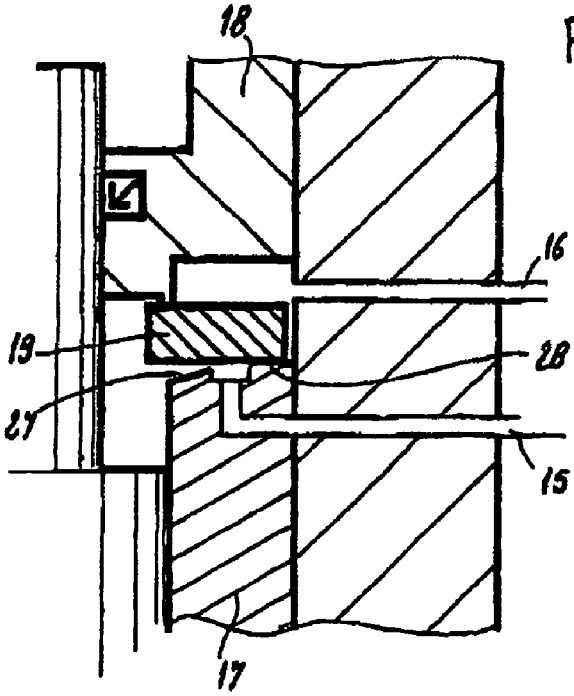
FIG. 9 is a partial sectional view, similar to FIG. 7, illustrating another device, in the non-fed position of the appliance.

FIG. 9 illustrates another embodiment, in which the washer 19 has a rectangular cross section, the bearing surface 28 of the washer on the immobile component 17 being raised, as compared with the preceding case, the starting pressure being capable of being determined by means of the value of the play between this surface 28 of the bearing plane of the washer and the upper end of the slope 27. The appliance can function only when the feed pressure has reached a sufficient value for the deformation of the washer 19 to allow the latter to bear on the slope 27 after the bearing surface 28 on the immobile component 17 has been released.

FIGS. 10 to 13 illustrate another embodiment, in which the same elements are designated by the same references as before. In this embodiment, the elastic washer 19 is intended for giving rise to a variable contraction on a circuit which diverts part of the feed flow of the appliance directly towards the return circuit R.

In this case, the duct 15 coming from the distributor 7 is connected directly to the low-pressure return duct 16 towards the reservoir. A duct 29 connected to the chamber 13 for the ascent of the piston issues into the duct 24 formed in the immobile component 17. As a variant, the duct 24 could be fed directly from the high-pressure feed, that is to say from the duct 6. For a similar result, the duct 24 could likewise be connected to the upper chamber 14, thus being connected alternately to the low pressure and then to the feed pressure as a function of the position of the distributor 7. In this arrangement, the upper chamber 14 is constantly isolated from the duct 24 and from the outlet duct 16 by means of the washer 19. As shown particularly in FIGS. 12 and 13, the immobile component 17 comprises a rim 30 partially surrounding the outside diameter of the washer. In the embodiment illustrated in the drawings, the washer simply has an inclined face 32 on its lower face and towards the inside. During starting, when the feed pressure increases and acts on the movable component 18, the washer 19 is deformed progressively, and then, when the desired pressure is reached, the deformation of the washer 19 is such that the rim 30 is no longer leak-tight on the outside diameter of the washer and gives rise to a contraction 26 of variable cross section, as shown in FIG. 13. This contraction 26 causes a hydraulic flow between the duct 24 and the return duct 16. A part of the flow which would normally have had to pass via the striking mechanism is then diverted directly towards the return R. The effect of this is to reduce and regulate the feed pressure to a predetermined limit value.

As may be gathered from the foregoing, the invention affords a great improvement to the existing art by providing a pressure regulation device of simple structure which functions highly effectively and is especially useful for equipping hydraulic percussion appliances to be produced under economical conditions and the structure of which is composed of cylindrical components fitted into the bore of the body.

It goes without saying that the invention is not limited only to the embodiments of this device which are described above by way of example, but, on the contrary, it embraces all its variants. Thus, in particular, the shape of the elastic washer could be different or the immobile component 17 could form an integral part of the body, without thereby departing from the scope of the invention.

The invention claimed is:

1. Pressure regulation device for a hydraulic percussion appliance, comprising a body within which is formed a bore having a plurality of zones of different diameters, in which is mounted a piston having a plurality of zones of different diameters, the bore and the piston delimiting a plurality of chambers connected to the hydraulic circuit, in order, under the action of a distributor, to ensure an alternating movement of the piston which strikes against a tool, wherein two axially offset components are mounted in the bore of the body and concentrically to the piston, between which components a deformable washer is arranged, one of the components being immobile and the other component being mounted slidably in the bore and displaceably in the direction of the immobile component under the action of the hydraulic fluid feed pressure which is exerted on that face of the movable component which faces away from the immobile component, this displacement of the movable component causing a deformation of the elastic washer in order to give rise to a passage of variable cross section on the circuit for the return of the hydraulic fluid towards the reservoir or on a circuit which diverts part of the feed flow of the appliance towards the return circuit, so as to regulate the inlet pressure.

2. Device according to claim 1, wherein the immobile component has formed in it a duct connected to the hydraulic fluid high-pressure feed duct, directly or via an internal chamber, or, by means of a distributor, to a chamber partially delimited by the piston and put alternately under high and low pressure, this duct issuing into that face of the immobile component which faces the movable component and on which the elastic washer rests, whilst a duct connected to the return circuit towards the reservoir issues into an annular volume located on that side of the elastic washer which is opposite that bearing against the immobile component.

3. Device according to claim 1, wherein the movable component comprises, towards the immobile component, an annular recess delimiting a central nose intended for coming to bear on that part of the elastic washer which does not bear against the immobile component.

4. Device according to claim 1, wherein the elastic washer possesses a cross section of rectangular general shape, the lower face of which has, from the outside inwards, a heel for bearing on the immobile component, and a surface which is parallel to the heel and set back from the latter and is connected by means of an edge to a surface inclined from the outside inwards and from the immobile component towards the movable component.

5. Device according to claim 1, wherein the elastic washer possesses a cross section of rectangular general shape, and that part of the wall of the immobile component which is located radially inwards and serves as a bearing means for the elastic washer is inclined from the outside inwards and in the opposite direction to the movable component.

6. Device according to claim 1, wherein the immobile component comprises an outer annular rim, the inside diameter of which is slightly smaller than the outside diameter of the elastic washer.

7. Device according to claim 1, wherein the elastic washer is made from steel.

8. Device according to claim 1, wherein the immobile component forms an integral part of the body.

9. Device according to claim 7, wherein the elastic washer is made from spring steel.

* * * * *